United States Patent [19]

Vasquez

[11] Patent Number: 4,675,085

[45] Date of Patent: Jun. 23, 1987

[54] METHOD AND APPARATUS FOR RECOVERY OF METAL FROM SOLUTION

[76] Inventor: Adalberto Vasquez, 310 N. Valley, San Antonio, Tex. 78216

[21] Appl. No.: 814,919

[22] Filed: Dec. 30, 1985

Related U.S. Application Data

[63] Continuation-in-part of Ser. No. 761,146, Jul. 31, 1985, abandoned.

[51] Int. Cl.[4] ..... C25C 1/00

[52] U.S. Cl. ..... 204/105 R; 204/109; 204/228; 204/229; 204/231; 204/272; 204/273; 204/275; 204/400; 204/435

[58] Field of Search ..... 204/105 R, 109, 272, 204/273, 275, 228, 229, 231, 400, 435, 237

[56] References Cited

U.S. PATENT DOCUMENTS

| | | | |
|---|---|---|---|
| 3,458,425 | 7/1969 | Tolle et al. | 204/109 |
| 3,560,366 | 2/1971 | Fisher | 204/109 |
| 4,028,212 | 6/1977 | Bowen | 204/109 |
| 4,280,884 | 7/1981 | Babb et al. | 204/109 |
| 4,362,608 | 12/1982 | Biles et al. | 204/109 |
| 4,377,456 | 3/1983 | De Meester et al. | 204/109 |
| 4,439,300 | 3/1984 | Houseman | 204/109 |

FOREIGN PATENT DOCUMENTS

| | | | |
|---|---|---|---|
| 2067598 | 7/1981 | United Kingdom | 204/109 |

*Primary Examiner*—R. L. Andrews

*Attorney, Agent, or Firm*—Cox & Smith Inc.

[57] ABSTRACT

Apparatus and method for recovering metal from a metal-containing solution. The apparatus is comprised of a case containing an anode and a cathode in fixed, spaced relationship relative to each other, and a power supply operable to apply a voltage across the anode and cathode. The increase in voltage between said anode and cathode is continually monitored and compared to a reference voltage until the increase exceeds the reference voltage, at which point a solenoid valve is energized to open a drain and drain the metal-containing solution from the case. A pump is provided to constantly circulate the metal-containing solution from top to bottom in the case while the voltage is applied between the anode and cathode to mix the solution, facilitating the plating of the metal. Also provided is a hollow, spiral anode, the solution being circulated through the hollow anode and out through the walls of the anode toward the cathode.

12 Claims, 6 Drawing Figures

METHOD AND APPARATUS FOR RECOVERY OF METAL FROM SOLUTION

BACKGROUND OF THE INVENTION

The present application is a continuation-in-part application of my co-pending application Ser. No. 761,146, filed on July 31, 1985, now abandoned.

The present invention relates to the recovery of metal from solution. In particular, the present invention is directed to the recovery of silver from the solution of silver thiosulfate which results from the removal of unreduced silver from photographic film using a solution of sodium thiosulfate or ammonium thiosulfate, also called hypo.

A serious limitation of electrolytic cells used for silver recovery is their tendency toward formation of silver sulfide during electrolysis. The formation of silver sulfide (commonly referred to as "sulfiding") reduces the number of silver ions which are available for reduction to metallic silver and subsequent recovery. A reduction in the amount of silver sulfide formed results in an increase in the silver ions available for recovery and hence, an increase in the efficiency of silver recovery.

Sulfiding is caused by an electrolysis voltage which is set too high for a given set of physical parameters of the electrolytic cell at a given solution concentration. The concentration of silver ions in the solution decreases as electrolysis progresses, and is rapidly diminished proximal to the cathode. The rapid diminishment near the cathode makes constant agitation and mixing of the solution of utmost importance. The electrolysis voltage must be continuously monitored and adjusted to partially control this sulfiding problem. However, as a practical matter, most electrolysis cells are switched on and left unattended and are not so adjusted. Further, most cells lack the circuitry required to turn the unit off when silver recovery is completed. Under extreme conditions, nearly all the available silver ions will be converted to silver sulfide and washed down the drain with the overflowing effluent or collected as an undesirable sludge at the bottom of the electrolytic cell. Further, leaving the power supply of the unit on once silver recovery has been completed results in needless wear and tear on the unit and the production of obnoxious odors. The present invention avoids the sulfiding of silver by pre-setting the electrolysis voltage at a level which is slightly below that level which would cause sulfiding to maximize the recovery rate and by utilizing sensing circuitry which allows the unit to operate only when necessary, thereby saving wear and tear on its moving parts. The control circuitry senses the increase in voltage across the electrodes as silver recovery progresses, and hence, the silver ion content of the solution, switching off the power to the electrodes and draining the solution from the cell when the silver concentration of the solution is decreased to a preset comparison level.

Unlike most other electrolytic silver recovery units, the present invention circulates the silver thiosulfate solution to accomplish the agitation of the solution which is necessary to insure efficient silver recovery. The circulation necessary to achieve the agitation and mixing is, however, accomplished in a new and unique fashion. The solution is pumped into a spiral tube comprising the anode of the cell, the longitudinal axis of the spiral oriented in a direction parallel to the longitudinal axis of the case of the electrolytic cell. The cathode is located within the spiral and the axis of the cathode is also parallel to the longitudinal axis of the case of the cell. The spiral anode is provided with small holes along the length of the spiral and on its inner aspect so that the solution in the spiral anode, which is under higher pressure than the solution contained within the case of the cell, escapes from the spiral tube through those holes, thereby being sprayed over the entire surface of the cathode.

Because the amount of solution which is being circulated by the apparatus of the present invention at any given time, as compared to the overall volume of solution, is small, and because the weight of that volume of solution does not change appreciably throughout the process, a pump of modest capacity can be used. Stationary electrodes are utilized, thereby presenting significant advantages compared to other electrolytic silver recovery units which rotate or otherwise move one or the other of the electrodes. When a rotating cathode is used, a motor large enough to rotate a heavy cathode assembly must also be used. The disadvantage of rotating the cathode is aggravated by the fact that, as deposited silver builds up on the cathode, the cathode gets heavier and eccentric. The eccentricity and the increased weight of the cathode cause increased wear on the motor and bearing assemblies. After a relatively short period of time, units of this type become increasingly noisy due to progressive bearing wear until they finally fail. The premature failure of the motor and/or bearing assembly of this type of unit is one of the most common problems associated with rotating cathode units.

Most electrolytic silver recovery units are of the "flow-through type". The term "flow-through" refers to the operation of the unit such that the solution is being continuously processed and, when the container is full, the solution overflows into the drain as new fixer is introduced. Units of this type will cause the silver to be deposited properly only when used in high volume environments, i.e., where the solution in the unit is always being replenished. A major disadvantage of this type of silver recovery unit is that a considerable amount of silver-laden fixer goes down the drain. In processing environments in which a lesser amount of fixer is used, fresh incoming fixer is mixed with semi-processed, or completely de-silvered, fixer, resulting in inefficient electrolytic action, and therefore, sulfiding. The result is wasted energy, obnoxious odors and very poor deposition of the silver ions due to sulfiding. In small volume environments, units of this type are of little use due to the fact that the solution is depleted of silver ion content nearly all of the time while the voltage is maintained at the same, inefficient, relatively high level.

The present invention overcomes the disadvantages and limitations of prior electrolytic cells by storing fresh solution in the recovery unit until an adequate amount of solution is available for processing. If, during processing, more fixer is made available, there is a "buffer zone" of silver ion content to accommodate the fresh fixer. When the solution is sufficiently de-silvered, it is automatically drained from the container to prevent fresh incoming fixer from becoming mixed with it. The unit is then ready to accept additional fixer. The dumping feature of the present invention obviates the use of low "plating" currents to control sulfiding at low silver ion concentrations.

In most present electrolytic silver recovery cells, the control of the "plating" current is provided by means of a rheostat which is accessible to an operator. Since current is a function of voltage, it is actually the electrolytic voltage that is being adjusted with that rheostat. Since the optimum voltage for plating is a function of, among other things, the concentration of the metal in the solution, the setting of the proper plating current is, at best, an approximation when the volume of operation is anything less than very high. Even in high volume environments, the voltage level is limited by the mechanical design of the electrolytic cell.

The present invention overcomes the limitations imposed by the necessity for selection of the voltage/current by fixing the voltage level at an optimum level for the range of concentrations found in a particular application, such as an X-ray department in a hospital, and only depleting the silver content of the solution down to a preselected level, as determined by the voltage level across the electrodes. This voltage level has been determined by experimentation, and is preset depending upon the particular use of the apparatus when the apparatus is installed.

In prior electrolytic cells in which the anode (usually in the form of carbon plates mounted on the opposing walls of a four-sided tank) is mounted on the periphery of the cell and the cathode (usually in the form of a series of disk-like plates or a cylindrical drum) is rotated, the area of the anode in close proximity to the cathode must be "time-shared" with the different areas of the cathode which move into position as the cathode rotates. Although the electric field is felt on all parts of the electrodes at any given point in time, the area of the field which is most efficient at plating the silver is that area of the cathode which is closest to the anode, which point is continuously changing, resulting in a loss in the efficiency of the process.

In the present invention, this inefficiency is avoided by the concentricity of the electrodes and the fixed distance between the anode and cathode. Consequently, the only variable which influences the optimum plating voltage is the concentration of the silver solution. Since the voltage is pre-selected, and fixed at the pre-selected voltage, it is the spacing between the anode and cathode and the agitation and mixing of the solution which dictates the upper limit of the voltage, the lower limit being dictated by the decomposition potential of the silver thiosulfate chemical complex in the solution. Further, the device used for agitation and mixing is the anode itself, but it does not move. The use of this configuration avoids the fact that, even in very rich solutions, sulfiding can occur if the voltage across the electrolytic cell is too high. The concentricity of the electrodes also means that all the available area of the anode always equally influences all the available area of the cathode.

The open system of the present invention has an advantage over those systems which are of the closed type. If the replenishment rate of fresh fixer in a closed system is not set at the proper level and the silver recovery system is not carefully regulated and monitored, the processed fixer will deteriorate the quality of the fixer in current use. Likewise, a failure to test the fixer in the film processor tank regularly will result in a deterioration of the fixer. The silver in the fixer is in solution, and not free, therefore it must undergo a chemical change to be recovered from the solution. When the altered solution is returned to the main fixer tank to be mixed with the rest of the fixer, the fixer is deteriorated, a major disadvantage to a closed system.

SUMMARY OF THE INVENTION

The present invention overcomes the limitations of these prior art electrolysis cells by providing an apparatus for recovering metal from a solution comprising a case having an inlet and an outlet for entrance and exit of a metal-containing solution, respectively, the outlet being normally closed, and means operable to selectively open the outlet for a predetermined period of time. A power supply is also provided which is operable to supply electromotive force to an anode and a cathode, the anode and cathode being fixed in spaced relationship to each other within the case. Means is provided for circulating the metal-containing solution within the case, as is a means for sensing the amount of metal-containing solution which has entered the case through the inlet, the sensing means being operable to start the power supply and the circulating means when a predetermined amount of metal-containing solution has entered the case. The apparatus is also provided with a means for sensing the electromotive force between the anode and the cathode, and for comparing that electromotive force to a predetermined reference level, the sensing and comparing means being operable to signal the outlet opening means to open the outlet when the electromotive force between the anode and the cathode exceeds the predetermined reference level.

Also provided is a method of recovering metal from a metal-containing solution. Metal recovery is initiated by filling a case with metal-containing solution until a level sensor is grounded by contact with the solution, a change which is detected by circuitry which energizes a pump and the electrodes. The voltage drop across the electrodes is monitored continuously and compared with a reference voltage. As electrolysis proceeds, the conductivity of the metal-containing solution decreases until the drop in voltage exceeds the reference voltage, at which point the solution is automatically drained from the case by energizing a solenoid valve in the outlet for a predetermined period of time. The pump and electrolysis voltage are simultaneously switched off. At the end of the predetermined period of time, the solenoid valve is de-energized to close the outlet, returning the apparatus to its original mode.

It is, therefore, an object of the present invention to provide an electrolytic cell which is energy efficient, which does not produce silver sulfide and the obnoxious odor which results from continued operation after desilvering, which is capable of operating unattended for long periods of time, and which recovers a sufficient quantity of metal to make operation of the apparatus economically feasible.

It is another object of the present invention to provide an apparatus capable of recovering an improved yield of silver, which silver is of higher purity than that recovered by other electrolysis cells.

It is another object of the present invention to provide an apparatus capable of economical operation in a number of silver recovery environments.

It is another object of the present invention to provide an apparatus which monitors the depletion of metal from a metal-containing solution, thereby maximizing the efficiency of recovery of the metal from the solution while avoiding the necessity for constant adjustment of the electrolysis voltage to avoid wasted energy and lost metal.

It is another object of the present invention to provide an apparatus for the recovery of metal from a solution in which the electrodes are held stationary inconstant, spaced relationship, thereby maximizing their effectiveness at metal recovery at a selected electrolysis voltage, and the metal-containing solution is circulated to insure adequate agitation, and hence, efficient metal recovery.

It is another object of the present invention to provide an apparatus which is capable of effectively storing and processing larger amounts of metal-containing solution than other known electrolysis units.

A further object of the present invention is to increase the rate of recovery of metal from a metal-containing solution.

Another object of the present invention is to provide an apparatus which, because of its increased effective storage and processing capacity and increased metal recovery rate, is more effective in preventing metal-bearing solution from being discharged into the environment.

Another object of the present invention is to recover silver of high purity, i.e., to accomplish what is known in the industry as "hard plating".

Other objects of the present invention will be apparent to those skilled in the art from the following detailed description.

DETAILED DESCRIPTION OF THE INVENTION

Figure 1:
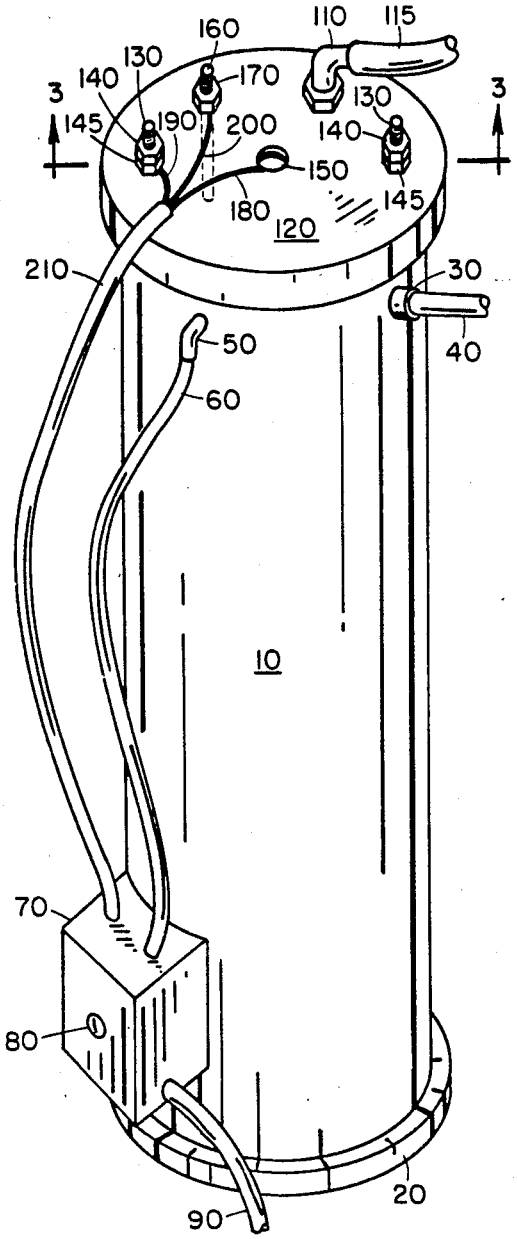
FIG. 1 is a perspective view of the apparatus of the present invention.

Referring to FIG. 1, there is shown a case 10 which is securely mounted to a base 20 to permanently seal one end of the case 10. An inlet port 30 is screwed into a threaded hole (not numbered) in the case 10. A flexible plastic hose 40 from a source of metal-containing solution is connected to the inlet port 30. An overflow port 50 is also screwed into a threaded hole (not numbered) in the case 10. A flexible overflow hose 60 is connected at one end to the overflow port 50 and at the other end to a drain tee union 340 (see FIG. 3), as will be explained. Cover 70 is secured to case 10 with a threaded stud/nut combination 80, and a flexible drain hose 90, which is connected to one side of drain tee union 340 (see FIG. 3), exits through the hole (not numbered) in the cover 70. A lid 120 is provided which forms a tight fit onto the top of the case 10. A vent port 110, which is open to the atmosphere, screws into a threaded hole (not numbered) in the lid 120, and is provided with a flexible hose 115. The threaded rod 130, which serves as the terminal of the cathode, projects through a hole (not numbered) in lid 120. The nuts 140 and 145 allow for the securing of the electrical connector. Screw 150 is the terminal of anode 260 (see FIGS. 2 and 3).

Threaded rod 160 projects through a hole (not numbered) in lid 120 and serves as the solution level sensor. Nut 170 is threadably mounted on the rod 160 and secures the electrical connector 200 to the rod 160. Wire 180 is provided for connection to the anode bolt 150 and wire 190 is provided for connection to the cathode rod 130 by means of nuts 140. Electrical cable 210 is a three-conductor cable which contains the anode conductor 180, the cathode conductor 190, and the solution level sensor conductor 200.

Figure 2:
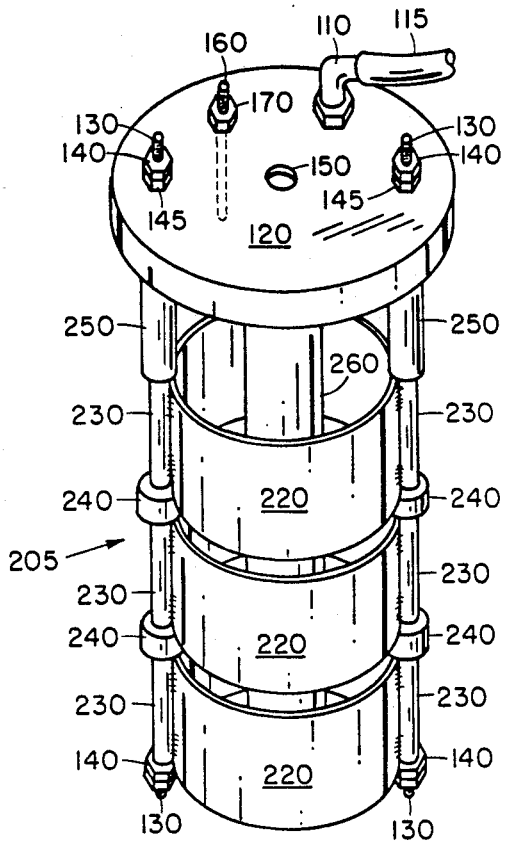
FIG. 2 is a perspective view of the electrode assembly of the apparatus of FIG. 1.

Referring to FIG. 2, the entire electrode assembly 205 is shown removed from the case 10. The electrode assembly 205 is provided with three separate stainless steel cathode rings 220. Onto each ring 220, two stainless steel tubes 230 are welded. These tubes 230 allow the cathode bolts 130 to mechanically bind the three rings 220 together. Graphite spacers 240 are used to separate each cathode ring 220 from its adjacent cathode ring. The graphite spacers 240 are provided with a hole (not numbered) to allow passage of the cathode bolt 130. A plastic spacer 250 is provided to separate the lid 120 from the first cathode ring 220. The spacer 250 is a plastic tube through which cathode bolt 130 passes. (As described above, nuts 140 and 145 secure the assembly on both ends of the cathode bolt 130.)

A graphite rod 260 is secured onto the inside center of lid 120 with a screw 150. In one embodiment of the present invention, the interior of the graphite rod 260 (see FIG. 3) is hollowed out to form a space 262 with holes 264 to allow the passage of the metal-containing solution into and out of the space 262, thereby increasing the surface area of the graphite rod 260. In an alternative configuration of this embodiment of the present invention (not shown), the graphite anode rod 260 may be secured to the bottom 20 of the case 10. All bolts, screws and nuts are comprised of stainless steel or other corrosion resistant material.

Figure 3:
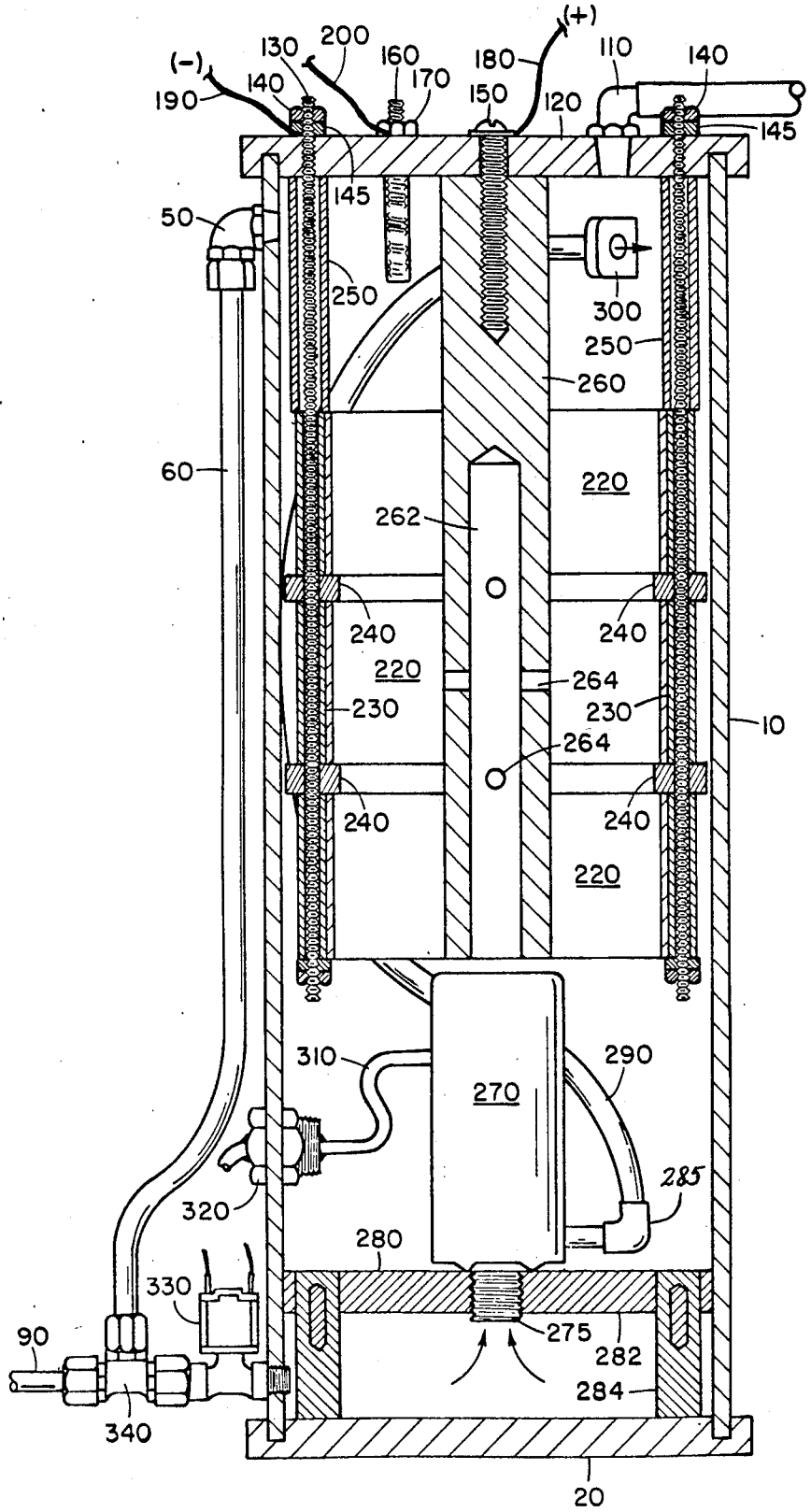
FIG. 3 is a longitudinal, sectional view of the apparatus of FIG. 1 taken along the lines 3-3.

Referring to FIG. 3, pump 270 is mounted on threaded inlet port 275 which is screwed into a threaded hole (not numbered) in the pump base assembly 280. The pump base assembly may be constructed in any conformation that will allow the passage of the metal-containing solution down past the pump base 282 and then up through the threaded inlet port 275. In one embodiment of the present invention, the pump base assembly 280 is constructed of three pieces of PVC plastic or other corrosion-resistant material, the pump base 282 and the legs 284, which are machined and then cemented together to form an appropriate support for the pump 270. The metal-containing solution exits from the pump 270 through outlet port 285, which is connected to a section of nylon tubing 290 which extends to the top of case 10 and terminates at tubing support 300. The power cord 310 is passed through a hole in the side of the case 10 through bulkhead union 320.

Drain solenoid valve 330 is threaded on one side through the hole (not numbered) in the side of the case 10, and the other side of the drain solenoid valve 330 is connected to the drain tee union 340. As noted above, the tee of the drain tee union 340 is connected to overflow tube 60. The other side of the drain tee union 340 is connected to flexible drain hose 90.

Figure 4:
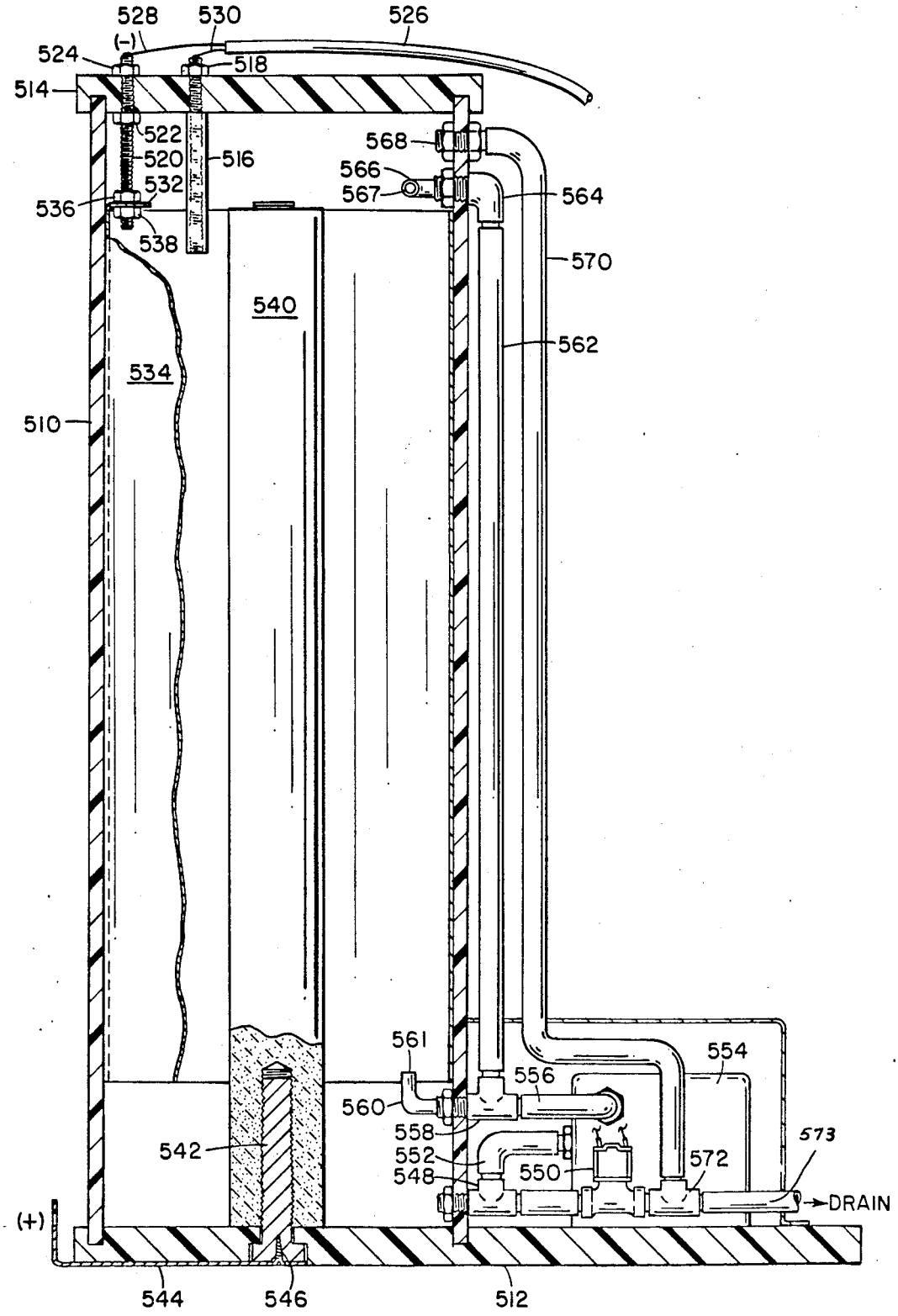
FIG. 4 is a longitudinal, sectional view similar to FIG. 3 of an alternative embodiment of the present invention.

Referring now to FIG. 4, there is shown a longitudinal section through an alternative embodiment of the present invention. In this embodiment, the case 510 is provided with a base 512 and a lid 514. Solution sensor rod 516 passes through a hole (not numbered) in the lid 514 and is secured in place by nuts 518. The cathode bolt 520 is provided with nuts 522 and 524 to secure it in place on either side of the lid 514, the bolt 520 itself passing through a hole (not numbered) in the lid 514. A two conductor electrical cable 526 is provided through which the wires 528 and 530, which are connected to the cathode rod 520 and solution sensor rod 516 respectively, run.

The cathode rod 520 passes through a hole (not numbered) in tab 532 which is integral with the cathode 534. Nuts 536 and 538 secure the cathode rod 520 in place on the tab 532. The cathode 534 is a stainless steel sleeve sized to fit closely within the cylinder formed by the case 510.

Extending up through the middle of the cylinder of the cathode 534 is a graphite anode rod 540. The anode rod 540 is threadably mounted on bolt 542 which passes through the base 512 of the case 510. Electric current reaches the anode rod 540 by passing through the bolt 542, the strap 544 and a connector wire (not shown) which attaches at one end to the electrolysis power supply 584 (see FIG. 5) and at the other end to the strap 544. A small screw 546 may be provided to secure the electrical connecting strap 544 to the bottom 512 of the case 510 and to insure good electrical contact with the bolt 542.

A tee union 548 is threaded on one side through a hole (not numbered) in the wall of the case 510. The other side of the tee union 548 is provided with a solenoid valve 550, as will be explained. The tee of the tee union 548 is provided with a flexible hose 552 which leads to pump 554, and the outlet of the pump 554 is provided with a hose 556 which connects to one side of tee union 558. The other side of the tee union 558 is threaded through the hole (not numbered) in the wall of the case 510. The side of the tee union 558 which is threaded through the case 510 is provided with an elbow 560 to direct the solution upwardly between the cathode 534 and anode 540. The elbow 560 is provided with a nozzle 561 with an internal diameter approximately half the diameter of hose 556. The tee of tee union 558 is provided with a manifold 562 which connects to the threaded elbow 564 which passes through a hole (not numbered) in the wall of case 510. The portion of the threaded elbow 564 which is inside of the case 510 is provided with an elbow 566 and nozzle 567 to direct the flow of metal-containing solution in a direction which is perpendicular to the longitudinal axis of the case 510. Like nozzle 561, the inside diameter of nozzle 567 is approximately half the diameter of the hose 556. Because of the reduced diameter of nozzles 561 and 567, the flow of metal-containing solution out of pump 554 is split, half through elbow 560 and half through manifold 562 and elbow 566, thereby insuring adequate mixing.

An outlet port 568 is threaded through a hole (not numbered) in the case 510 and provided with a flexible drainage hose 570 which is attached to the tee of the drain tee union 572. One side of the drain tee union 572 is attached to the solenoid valve 550 and the other is attached to a flexible hose 573.

Figure 5:
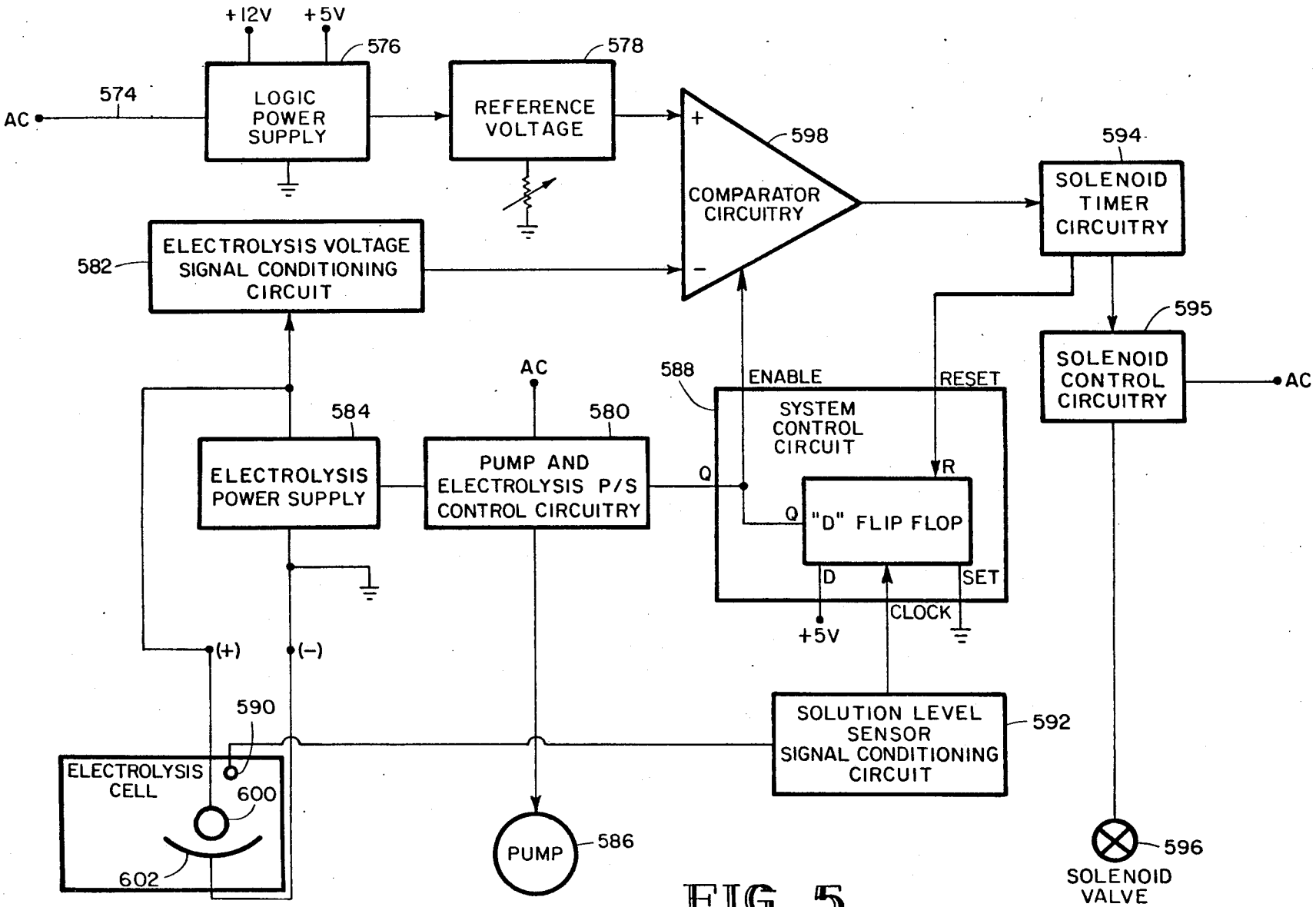
FIG. 5 is a schematic diagram of the control circuitry of the present invention.

Referring to FIG. 5, there is shown a circuit diagram for the apparatus of the present invention. Line voltage at 120 volts, alternating current, is directed through line 574 to the logic power supply 576, the pump and electrolysis power supply control circuit 580, and the solenoid control circuit 595. As long as the line voltage is supplied to the system, the logic power supply 576 is energized and will provide the required supply voltages to the various integrated circuits in the system. Initially, the case 10 (see FIG. 1) is empty and the system is in a standby mode. The pump and electrolysis power supply (PEPS) control circuit 580 will keep the line voltage from energizing the electrolysis power supply 584 and the pump 586 due to the absence of an appropriate signal from the system control circuit 588. The primary function of the system control circuit 588 is to insure that the electrolysis operation begins only after the case 10 has been filled with a predetermined amount of metal-containing solution and that the electrolysis and drainage functions occur at the proper time. System control circuit 588 includes a D flip-flop, the D input is set high and the set input is grounded.

During the standby mode, the electrolysis voltage signal from the electrolysis voltage signal conditioning circuit 582 is close to zero, making the reference voltage 578 higher than the electrolysis voltage. The comparator circuit 598 reflects this condition, and no functions are activated.

As case 10 is filled with metal-containing solution, the solution level reaches the level sensor 590. Case 10 holds approximately five gallons of solution, and it may be filled approximately 100 ml at a time (i.e., the amount of replenishment solution required by a standard X-ray film as it is placed in a tank of fixer). When the amount of solution is sufficient to allow it to reach the level sensor 590, the level sensor 590 is grounded and that change in status is received and conditioned by the solution level sensor signal conditioning circuit 592. The output of the solution level sensor signal conditioning circuit 592 is a digital pulse that is sent to the system control circuit 588. That digital pulse initiates an output signal Q from the system control circuit 588 to the PEPS control circuit 580, thereby energizing the pump 586 and the electrolysis power supply 584. The reset signal from the solenoid timer circuit 594 is provided to insure that the electrolysis and drain functions are mutually exclusive. The system is now in the operational mode rather than the standby mode, the pump 586 and electrolysis power supply 584 are now on, and the solenoid valve 596 is closed (de-energized).

When the electrolysis power supply 584 is energized, the electrolysis voltage is also introduced into the electrolysis voltage signal conditioning circuit 582. The output of electrolysis voltage signal conditioning circuit 582 is monitored by the inverting input of the comparator circuitry 598. If the metal-containing solution has a high metal content, it will be characterized by a high conductivity, and the voltage drop across the anode 600 and cathode 602 will be small when compared with the reference voltage appearing at the non-inverting input of the comparator circuit 598. When an enabling signal is received from the system control circuit 588, the comparator circuit 598 is allowed to respond to its input signals, but at this point, nothing else happens. During electrolysis, metal ions are reduced to their metallic form at the cathode, causing a decrease in the conductivity of the metal-containing solution. The decrease in the conductivity of the solution results in an increase in the drop in voltage across the electrodes. As electrolysis continues, the metal-containing solution will become sufficiently depleted of metal ions to cause the electrolysis voltage signal at the inverting input of the comparator circuit 598 to exceed the reference voltage 578. At that point, the output of the comparator circuit 598 switches, initiating the solenoid timer circuit 594.

A signal is sent to the solenoid control circuit 595 by the solenoid timer circuit 594 for a pre-determined length of time, that pulse duration being the drain time. The solenoid control circuit 595 energizes the solenoid valve 596 to initiate the draining of the metal-containing solution. At the same time that the solenoid timer circuit 594 begins the timing pulse, a signal (reset pulse) is also sent by it to the system control circuit 588 to stop the pump 586 and the electrolysis power supply 584. At that point in time, the signal at the inverting input of the comparator circuit 598 goes to zero, initiating the drain cycle. At the end of the drain cycle, the metal-containing solution is drained and the solenoid valve 596 is de-energized to return the system to the standby mode.

As is clear from FIG. 3, when the pump 270 is operating, the metal-containing solution is drawn in through the inlet 275 and pumped out the pump outlet port 285 through the nylon tubing 290 and out of the opening in the pump tubing support 300 near the top of the case 10. A circulation of fluid from the top of the case 10 to the bottom is thereby set up. When the solenoid valve 330 is activated, the fluid flows out through the drain tee union 340 and to the drain. Should an amount of metal-containing solution enter the case 10 which exceeds the capacity of the case 10 (the solenoid valve 330 will be closed because the apparatus is in the operational mode but not in the draining cycle), the metal-containing solution can drain through the overflow port 50 and overflow tubing 60 into the drain tee union 340 and on to the drain or another electrolysis unit through hose 90.

Referring to FIG. 4, a similar scheme governs the flow of metal-containing solution. The metal-containing solution is introduced through an inlet (not shown in the longitudinal sectional view) and, with the apparatus in the standby mode, fills the case 510 until the level sensor 516 is grounded. At that point, the pump 554 is switched on, drawing fluid through the inlet port 548 and inlet hose 552 through the pump 554 and outlet hose 556, and into the case 510 through the nozzles 561 and 567. Should the amount of metal-containing solution exceed the capacity of the case 510, the outlet 568 is provided so that the solution will drain through the hose 570 into the drain tee union 572 and on to the drain or other electrolysis unit. When the metallic ion content of the metal-containing solution is sufficiently depleted that the drop in voltage across the cathode 534 and anode 540 reaches the predetermined reference voltage, the solenoid valve 550 is activated, allowing the solution to drain through the drain tee union 572.

Figure 6:
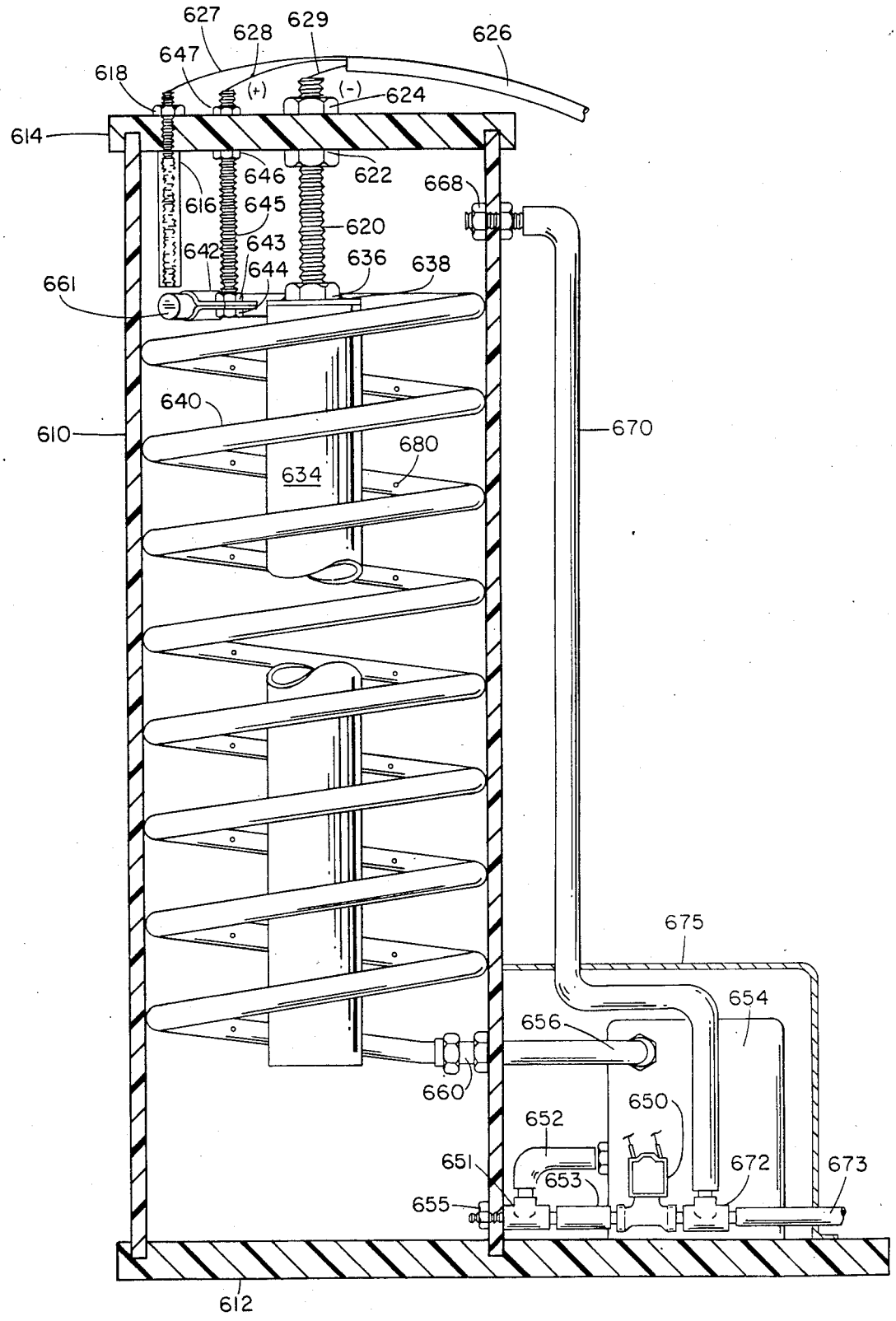
FIG. 6 is a longitudinal, sectional view similar to FIG. 3 of an alternative, presently-preferred embodiment of the present invention.

Referring now to FIG. 6, there is shown a longitudinal sectional view of an alternative, presently-preferred embodiment of the present invention. In this embodiment, the case 610 is provided with a base 612 and a lid 614. Solution sensor rod 616 passes through a hole (not numbered) in the lid 614 and is secured in place by a nut 618. The anode bolt 645 is provided with nuts 646 and 647 to secure it in place on either side of the lid 614, the bolt 645 itself passing through a hole (not numbered) in the lid 614. The cathode bolt 620 is provided with nuts 622 and 624 to secure it in place on either side of the lid 614, the bolt 620 itself passing through a hole (not numbered) in the lid 614. A three-conductor electrical cable 626 is provided through which the wires 627, 628 and 629, which are connected to the solution sensor rod 616, anode bolt 645, and cathode bolt 620, respectively, run.

The anode bolt 645 passes through a hole (not numbered) in clip 642. Nuts 643 and 644 secure the anode bolt 645 to the clip 642 and secure clip 642 to the anode 640 to provide an electrical connection from anode bolt 645 to anode 640. A connector wire 628 attaches at one end to anode bolt 645 and at the other end to the electrolysis power supply 584 at positive terminal 600 (see FIG. 5). In the preferred embodiment, the anode 640 is a stainless steel tube wound in a spiral which fits closely within the cylinder formed by the case 610. The upper end of anode 640 is sealed at reference numeral 661, consequently the holes 680 on the inner aspect of anode 640 provide the only exit for the solution entering anode 640 from pump 654 via the end of flexible plastic hose 656 and fitting 660. In an alternative embodiment (not shown), the discharge outlet of pump 654 can be connected to both ends of anode 640 by the use of a "Y" fitting on flexible plastic hose 656. In both embodiments, the solution being circulated by pump 654 has only one exit from anode 640, namely, the holes 680.

Extending down through the center of the spiral anode 640 is a stainless steel cathode tube 634. The cathode tube 634, end plate 638, and cathode nut 636 are welded together to form one assembly. The cathode tube 634 is threadably mounted on the bolt 620 which passes through the lid 614 of the case 610. Electric current reaches cathode tube 634 by passing through the welded end plate 638, nut 636, bolt 620, and a connector wire 629 which attaches at one end to bolt 620, and at the other end to the negative terminal 602 of electrolysis power supply 584 (see FIG. 5).

A tee union 651 is threaded on one side through a hole (not numbered) in the wall of case 610. The other side of tee union 651 is provided with a solenoid valve 650 via flexible hose 653. Solenoid valve 650 is the same solenoid valve as the solenoid valve 596 of FIG. 5 (is the circuitry shown in FIG. 5 is used to operate the embodiment shown in FIG. 6). The function of the solenoid valve will be explained below. The tee of tee union 651 is provided with a flexible hose 652 which leads to pump 654, and the discharge outlet of pump 654 is provided with a hose 656 which connects to one side of a fitting 660 as discussed above.

The holes 680 on the interior aspect of anode 640 have a combined total area which is approximately equal to the cross-sectional area of the discharge outlet of the pump 654. The combination of adequate pump capacity and an adequate number and proper size of the holes 680 to insure that adequate pressure is developed produces an optimum amount of agitation of the solution contained within case 610. The agitation created by the discharge of solution through holes 680 towards cathode 634 results in turbulence in the solution adjacent cathode 634, thereby increasing the efficiency of the deposition of metal on the cathode 634.

An overflow outlet port 668 is threaded through a hole (not numbered) in case 610 and is provided with a flexible drainage hose 670 which is attached to the tee of drain tee union 672. One side of the drain tee union 672 is attached to solenoid valve 650 and the other is attached to a flexible hose 673.

The control circuit (see FIG. 5) automatically controls the operation of the power supply 584, pump 586 (reference numeral 654 in FIG. 6), and solenoid valve 596 (reference numeral 650 in FIG. 6). When the solenoid valve 650 is energized, all other functions are stopped. De-silvered solution is automatically drained from case 610 through solenoid valve 650 via drain fitting 655, tee union 651, and flexible hose 653. The other side of solenoid valve 650 is routed to a drain via drain tee union 672 and flexible hose 673.

Normally the case 10 (FIG. 3), 510 (FIG. 4), or 610 (FIG. 6) will fill with solution and the apparatus will begin operation until the drop in voltage across the electrodes exceeds the reference voltage, the reference voltage being selected as that voltage at which a majority of the metal has been recovered from the solution. Additional metal-containing solution overflows into overflow port 50 (FIG. 3), 568 (FIG. 4), or 668 (FIG. 6) and either down the drain or to another apparatus. Because the overflow may be lost down the drain, it is important that the recovery of metal from the solution in case 10 (FIG. 3), 510 (FIG. 4), or 610 (FIG. 6) proceed as quickly and efficiently as possible. Consequently, the reference voltage is selected on the basis of optimizing electrolysis time, electrolysis voltage efficiency, and the amount of metal-containing solution which must be processed.

Although the invention has been described in terms of the preferred embodiments illustrated, these illustrations are provided by way of exemplification only, and not by way of limitation. Those skilled in the art who have the benefit of this disclosure will recognize that certain changes in the present invention, such as a change in the design of the circuitry shown in FIG. 5, may be accomplished without departing from the spirit and scope of the invention, which is limited only by the following claims.

What is claimed is:

1. A method of recovering metal from a metalcontaining solution comprising:

filling a case with metal-containing solution;

activating a solution level sensor with said metal-containing solution when a predetermined amount of solution has entered said case;

applying a voltage to said solution across an anode and a cathode in response to a signal from the activated solution level sensor;

circulating said solution through the interior of said anode, said anode being spiral shaped, and out of said anode through holes in the inner aspect of the spiral towards said cathode, said cathode being centrally located within the spiral, in response to a signal from the activated solution level sensor;

monitoring the increase in voltage between said anode and said cathode and comparing said increase to a predetermined reference voltage;

draining said metal-containing solution from the case when said predetermined reference voltage is exceeded; and stopping said circulation and shutting down said voltage across said anode and said cathode.

2. The method of claim 1 further comprising energizing a timer circuit to open a solenoid valve for a predetermined period of time to drain said solution from the case when said reference voltage is exceeded.

3. The method of claim 2 wherein said timer circuit opens said solenoid valve for a period of time sufficiently long to empty the case.

4. The method of claim 1 wherein the voltage applied across said anode and said cathode is constant.

5. Apparatus for recovering metal from a metal-containing solution comprising:

a case having an inlet and an outlet for entrance and exit of a metal-containing solution, respectively, said outlet being normally closed;

means for selectively opening said outlet to drain said case of metal-containing solution;

means for circulating the metal-containing solution with said case;

a vertical cathode rod centrally located within said case;

a hollow, spiral anode in fluid communication with said circulating means having a longitudinal axis substantially parallel to said cathode and a plurality of holes along the inner aspect thereof, said cathode being centered within said spiral anode whereby the metal-containing solution is discharged from within said anode towards said cathode through said holes;

a power supply for supplying voltage to said anode and said cathode;

means for sensing the amount of metal-containing solution within said case and for starting said power supply and said circulating means when a predetermined amount of metal-containing solution has entered said case; and means for sensing the voltage supplied to said anode and said cathode and for comparing the voltage to a predetermined reference voltage for signalling said outlet opening means to open said outlet when the voltage exceeds said predetermined reference voltage.

6. The apparatus of claim 5 wherein said solution circulating means comprises a pump, said outlet being operable to withdraw metal-containing solution from the bottom of said case and return said metalcontaining solution to said case through said anode.

7. The apparatus of claim 5 wherein said case is provided with a lid and said cathode is mounted to said lid whereby said lid and said cathode may be removed from said case as a single assembly for recovery of metal which has collected on said cathode.

8. The apparatus of claim 5 wherein said solution circulating means comprises a pump having an outlet in fluid communication with said hollow anode.

9. The apparatus of claim 8 where the total cross-sectional area of the holes in said anode is approximately equal to the cross-sectional area of the outlet in fluid communication with said anode.

10. Apparatus for recovering metal from a metal-containing solution comprising:

a case having an inlet and an outlet for entrance and exit of a metal-containing solution, said outlet being normally closed;

means for opening said outlet to drain said case;

means for circulating the metal-containing solution;

a substantially vertical cathode within said case;

a hollow anode concentric to said cathode between said cathode and the walls of said case and in fluid communication with said circulating means having a plurality of holes in the inner aspect thereof whereby the metal-containing solution is discharged from within said anode towards said cathode through the holes in said anode;

a power supply for supplying voltage to said anode and said cathode;

means for starting said power supply and said solution circulating means when a predetermined amount of metal-containing solution enters said case; and means for sensing the voltage supplied to said anode and said cathode and for comparing the voltage to a predetermined reference voltage for signalling said outlet opening means to open said outlet when the voltage exceeds said predetermined reference voltage.

11. The apparatus of claim 10 wherein said solution circulating means comprises a pump having an outlet in fluid communication with said hollow anode.

12. The apparatus of claim 11 wherein the total cross-sectional area of the holes in said anode is approximately equal to the cross-sectional area of the outlet in fluid communication with said hollow anode.

* * * * *